United States Patent [19]

Shier

[11] Patent Number: 4,774,492

[45] Date of Patent: Sep. 27, 1988

[54] SLOTTED INTEGRATED CIRCUIT RESISTOR

[76] Inventor: John S. Shier, 6935 133rd Ct., Apple Valley, Minn. 55124

[21] Appl. No.: 937,565

[22] Filed: Dec. 3, 1986

[51] Int. Cl.[4] ..... H01C 1/012

[52] U.S. Cl. ..... 338/309; 219/121.69; 338/195; 338/320; 338/333

[58] Field of Search ..... 338/306–309, 338/195, 203, 319, 320, 322, 327, 333–334; 219/121 LH, 121 LJ; 29/610 R, 620, 621, 619, 412–414

[56] References Cited

U.S. PATENT DOCUMENTS

| | | | |
|---|---|---|---|
| 3,388,461 | 6/1968 | Lins | 29/620 X |
| 4,031,272 | 6/1977 | Khanna | 427/96 |
| 4,138,671 | 2/1979 | Comer et al. | 340/347 |
| 4,150,366 | 4/1979 | Price | 340/347 |
| 4,210,996 | 7/1980 | Amemiya et al. | 29/610 |
| 4,215,333 | 7/1980 | Huang | 338/322 |
| 4,240,094 | 12/1980 | Mader | 219/121 LH X |
| 4,278,706 | 7/1981 | Barry | 29/620 |
| 4,306,246 | 12/1981 | Davies et al. | 357/36 |
| 4,344,064 | 8/1982 | Bitler et al. | 338/334 |
| 4,381,441 | 4/1983 | Desmarais et al. | 219/121 LJ |
| 4,412,241 | 10/1983 | Nelson | 357/51 |
| 4,456,894 | 6/1984 | Lapart | 333/22 R |
| 4,459,580 | 7/1984 | Furukawa | 340/347 |
| 4,468,652 | 8/1984 | Wang et al. | 340/347 |
| 4,539,622 | 9/1985 | Akasaki | 361/401 |
| 4,565,000 | 1/1986 | Brokaw | 29/611 |
| 4,580,030 | 4/1986 | Takeuchi | 219/121 |
| 4,586,019 | 4/1986 | Brokaw | 338/195 |

*Primary Examiner*—C. L. Albritton

*Attorney, Agent, or Firm*—Kinney & Lange

[57] ABSTRACT

A distributed wye resistor network fabricated on an integrated circuit substrate includes a resistive body coupled between two terminal elements. The resistive body includes a plurality of slots extending therethrough between the terminal elements to form a plurality of discrete resistive links. The resistive body therefore has characteristics of an artificial anisotropically conducting medium. The resistive links have a parabolic length profile. The links can be continuously cut, starting with the shortest link, until parameters of the integrated circuit are brought within desired specifications.

22 Claims, 2 Drawing Sheets

SLOTTED INTEGRATED CIRCUIT RESISTOR

BACKGROUND OF THE INVENTION

1. Field of the Invention

The present invention relates to resistive bodies fabricated on a substrate. In particular, the present invention is a slotted resistive body adapted for use on integrated circuits and which can be trimmed to a desired resistance value.

2. Description of the Prior Art

Many analog and other integrated circuits require precise matching of the resistance values of resistors fabricated thereon to achieve desired overall circuit precision. The "natural" level of matching for integrated circuit resistors (i.e., that achievable by controlling parameters of the manufacturing process) is approximately 0.1–0.3%. For some circuits such as high-precision analog-to-digital and digital-to-analog converters, this degree of precision is inadequate. To produce such high-precision devices, various forms of post-fabrication trimming have been devised to adjust the resistance value of one resistor of the matched pair. Known techniques include laser trimming or cutting, Zener-zapping, and metal-link cutting and blowing.

Other integrated circuits include individual resistors which must be trimmed to an absolute resistance value. In applications of these types, untrimmed accuracies on the order of only 15–20% are typical due to the wide manufacturing variations in sheet resistance of the integrated circuit.

Laser trimming involves the use of a laser beam to alter the shape of a resistor region and thereby bring its resistance to a desired value. At present, many kinds of trim geometries are used for this purpose. "Top Hat", "L-cut" and other trim patterns are common.

Serious problems arise from aging and annealing affects resulting from laser trimming techniques. The "partially zapped" material along the edge of the cut trim path often has different properties from undisturbed material, and its resistance ages (anneals) at a different rate than the body of the resistor. This can give rise to a situation where a resistor pair which was initially trimmed to a precise ratio exhibits a slow variation of the ratio due to aging effects. As a result, the circuit gradually drifts out of specification during usage.

To avoid aging problems, it is known to use a trimming geometry in which resistive links are either totally cut, or left undisturbed. The infinite resistance of a cut link is unaffected by aging. Known techniques which make use of this property include a set of resistive links which are connected in a parallel geometry. However, if N links are used, the resolution of the trim is only 1/N. Trim resolutions can be increased by using binary-weighted links with values in the ratio of 1, 2, 4, etc. A problem with these parallel-connected geometry arrangements is that although the spacings between conductance values is uniform, spacing between resistance values is not. Geometries of this type also require a large amount of area on the integrated circuit because sufficient space, typically on the order of at least twelve microns, must separate each link so that a laser beam can be inserted and withdrawn between individual links.

An integrated circuit resistor which includes a plurality of parallel sections is illustrated in the Brokaw U.S. Pat. No. 4,586,019. The resistor is formed as a plurality of parallel strips to match the sensitivities of different-sized resistors to relative changes in resistance resulting from changes in width.

Clearly, there is a continuing need for improved resistor networks and methods for trimming the resistance value thereof. The resistor network and method will preferably be applicable to both resistor matching applications as well as the selection of absolute resistor values. The resistor network must be compact so as to utilize little space on an integrated circuit, and yet permit high resolution (i.e., small intervals between adjacent trimmed values). A resistor network having these characteristics would be especially desirable if it were not susceptible to the effects of "aging" due to annealing affects. Other desirable characteristics of such a resistor network would be the capability of obtaining a uniform trim sensitivity, and suitability for use with traditional "adaptive" or "continuous" trim algorithms which do not assume prior knowledge or measurability of the desired resistor value.

SUMMARY OF THE INVENTION

The present invention is a resistor fabricated on a substrate in accordance with design constraints of a fabrication technology. The resistor includes a substrate, at least two terminal elements, and a resistive body fabricated on the substrate and coupling the terminal elements. A plurality of slots extend through the resistive body between the terminal elements to form a plurality of discrete resistive links. The slots have a width equal to a minimum width obtainable within the design constraints of the fabrication technology.

In preferred embodiments, the slots are parallel to one another, extend across the entire resistive body between the terminal elements, and have a maximum width of approximately three microns. The resistive links can also have a length profile which varies as a parabolic function.

Resistors of the present invention can be used in accordance with traditional "adaptive" or "continuous" trim algorithms which do not assume prior knowledge or measurability of the desired resistor value. Since the resistive links are separted by a minimum obtainable width, the resistor is very dense and utilizes little space on the integrated circuit. High resolution trimming can also be obtained. Aging effects due to annealing are also significantly reduced.

DETAILED DESCRIPTION OF THE PREFERRED EMBODIMENTS

Figure 1:
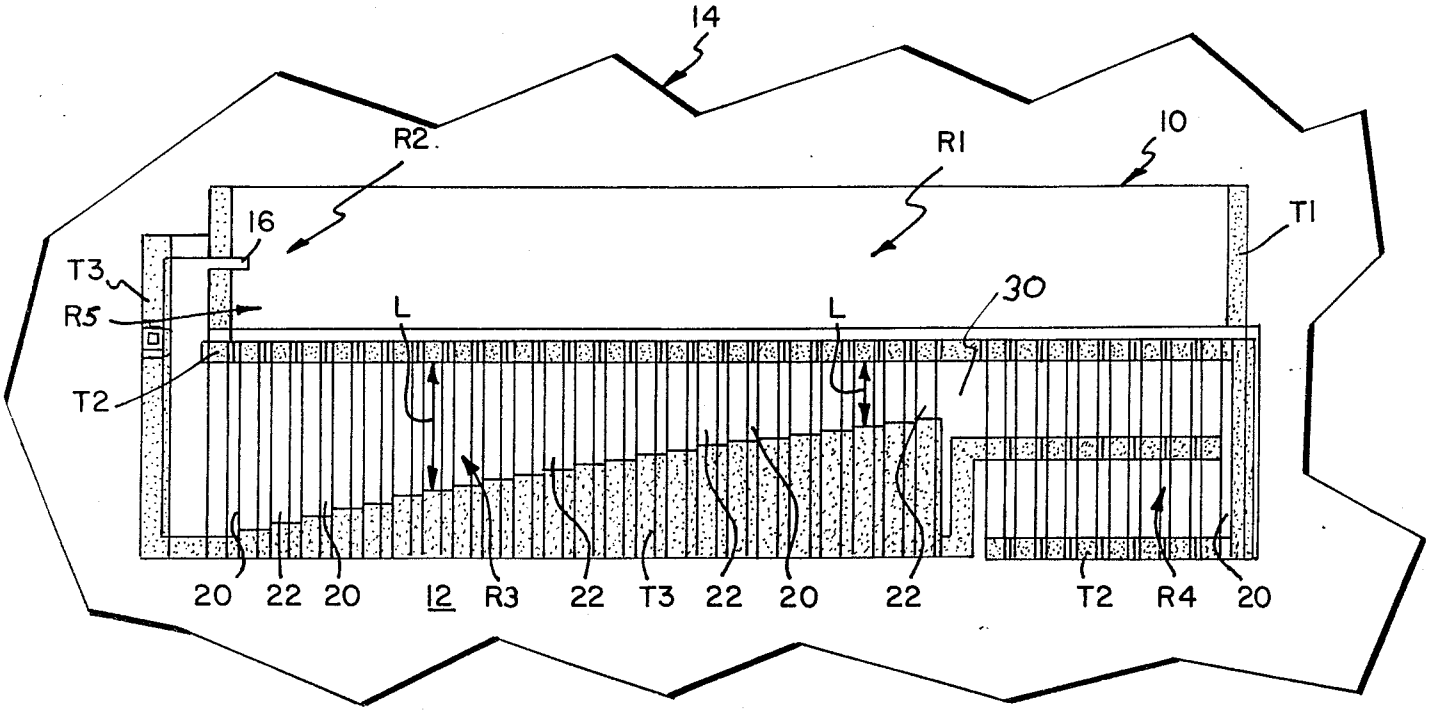
FIG. 1 is an illustration of a wye resistor network fabricated on an integrated circuit substrate in accordance with the present invention.

A distributed wye resistor network 10 in accordance with the present invention is illustrated in FIG. 1. Resistor network 10 is fabricated on a substrate 12 of an integrated circuit 14, and includes terminal elements T1, T2, and T3. As shown, terminal elements T1, T2 and T3 are elongated or distributed, with each representing portions of network 10 which have a common voltage potential. Resistor network 10 also includes resistive elements or bodies R1–R5. In one embodiment, resistive bodies R1–R5 are fabricated of thin film using CMOS fabrication technology. Other fabrication technologies capable of supporting thin film can also be used.

Due to the nature of distributed wye resistor network 10, individual resistive bodies R1–R5, and in particular bodies R1, R2 and R5, are not distinct and separate. However, it is well known that any resistive body contacted at three places can be accurately represented as a wye network. With this in mind, first resistive body R1 has a first end which is coupled to terminal element T1. Second resistive body R2 and fifth resistive body R5 are essentially different portions at an end of resistive body R1 opposite terminal element T1, and which are separated from one another by slot 16. However, for purposes of explanation, second resistive body region R2 can be described as having a first end coupled to terminal element T3, and a second end which is coupled to a second end of resistive body R1. Fifth resistive body R5 has a first end which is coupled to terminal element T2, and a second end which is coupled to the second ends of resistive bodies R1 and R2. Fourth resistive body R4 and third resistive body R3 are both coupled between terminal elements T2 and T3 as shown in FIG. 1.

Figure 2:
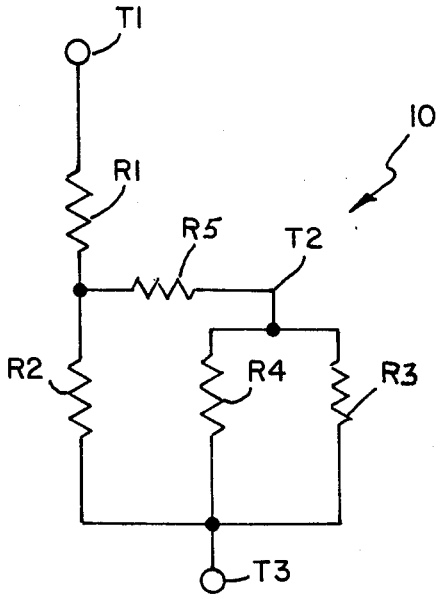
FIG. 2 is a schematic representation of the resistor network shown in FIG. 1.

A schematic representation of an electrical equivalent of wye resistor network 10 is illustrated in FIG. 2. Resistive bodies R1–R5 are represented as decrete devices in FIG. 2 for purposes of example. It is well known that by properly selecting the relative resistance values of a resistor network such as 10, relatively large changes to the resistance of resistive body R3 can function as a relatively "fine trim" of the overall resistance value seen between terminal elements T1 and T3. Furthermore, sensitivity of network 10 can be varied over broad ranges by suitable choices for the resistance of resistive bodies R1, R2, and R5. In most practical cases, resistance of resistive body R1 is much larger than that of resistive bodies R2–R5. The precise value of the resistance of resistive bodies R1–R5, however, will depend upon desired trim range, accuracy, sensitivity, and other desired electrical characteristics.

Referring again to FIG. 1, resistive bodies R3 and R4 are fabricated so as to include a plurality of slots 20 which extend through the film or other material from which they are formed to substrate 12. By fabricating integrated circuit 10 in this manner, resistive bodies R3 and R4 are formed by a plurality of discrete resistive links 22. In the embodiment shown, slots 20 extend between terminal elements T2 and T3 for the entire length L of links 22 (i.e., from terminal element T2 to terminal element T3), and are parallel to one another.

The purpose of slots 20 is to provide resistive bodies R3 and R4 which have characteristics of an artificial anisotropic conductive body. Current flow through resistive bodies R3 and R4 is substantially in a direction which is parallel to slots 20. To this end, it is desirable to interrupt resistive bodies R3 and R4 with as many slots 20 as possible. Resistive links 22 should therefore be spaced from another by slots 20 which have as narrow a width as possible. In one embodiment, resistive bodies R3 and R4 are formed by a plurality of resistive links 22 which are spaced from one another by slots 20 having a three micron width which is equal to the minimum width imposed upon circuit designers by design constraints of the particular CMOS technology by which resistor network 10 is fabricated on integrated circuit 14. The narrower the width of links 22, the higher the sensitivity which can be achieved when trimming network 10. In one embodiment, links 22 have a width of six microns. By constrast, known link cutting resistor schemes typically have individual resistor links which are separated by a distance of at least twelve microns so as to permit a laser beam to cut or sever the individual links without affecting the physical properties of adjacent links. This invention is therefore properly characterized as an improved solid resistive body, as opposed to an improved link cutting scheme.

Figure 3:
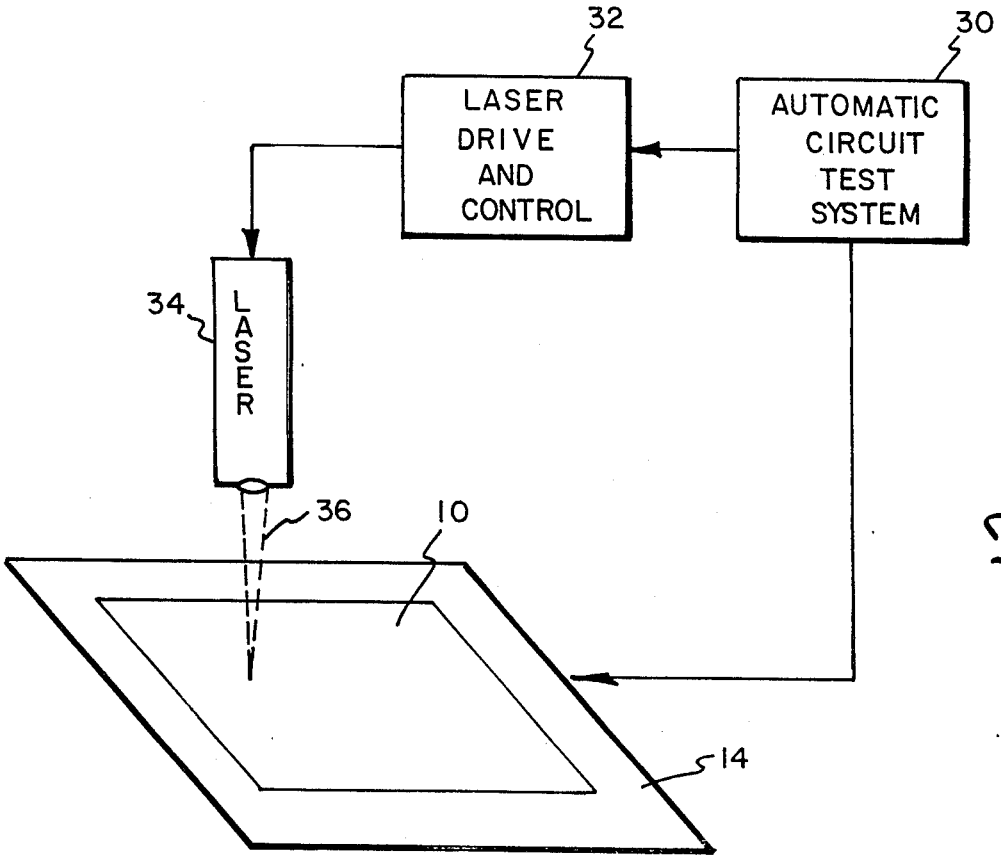
FIG. 3 is a block diagram representation of a system in accordance with the present invention for trimming resistor networks such as that shown in FIG. 1.

An apparatus for trimming a resistor network such as 10 is illustrated generally in FIG. 3. An integrated circuit 14 which includes a resistor network 10 (not shown in detail) is interfaced to an automatic circuit test system 30. Circuit test system 30 provides testing signals of a predetermined magnitude to integrated circuit 14, and monitors various current parameters, such as offset voltages or voltage gains, in response. Assuming these circuit parameters are not within specifications, automatic circuit test system 30 provides trim control signals to laser drive and control 32. In response, laser drive and control 32 provides laser drive and control signals to laser 34, causing laser 34 to produce a beam of radiation 36 which continuously cuts across resistive links 22 of resistive body R3 (FIG. 1), thereby increasing the resistance of resistive body R3, and also the resistance value of resistor network 10 as seen between terminals T1 and T3.

Simultaneously with the cutting operation described immediately above, automatic circuit test system 30 continuously monitors the circuit parameters. Once the continuous trimming operation has altered the circuit characteristics such that the circuit parameters are within desired specifications, automatic circuit test system 30 will provide a trim control signal which stops further cutting action.

Links 22 are not cut one at a time. The arrangement shown in FIG. 3 makes cuts continuously, and continuously measures circuit parameters to determine when to stop cutting. In many cases, a resistive link 22 can remain partially cut at the end of the trimming procedure.

Aging and instability problems resulting from resistors which drift out of specifications as a result of annealing of cut elements is not rigorously eliminated through the use of network 10 and the trimming procedure described above since one resistive link 22 can be partially cut. However, drift of an integrated circuit 14 which includes a resistor network 10 in accordance with the present invention will be greatly reduced, and an upper limit of how much drift can affect the final resistor value imposed. If, for example, there are N links, then the effect of any annealing can only be 1/N times as great as the effect in a single link 22. Furthermore, since trimmed resistive body R3 is only a "fine adjustment" to the overall resistance of resistor network 10, the overall drift effect on the resistance seen between terminals T1 and T3 by a partially cut link 22 will usually be very small.

To reduce the graininess, or small but discrete jumps, in resistance value of a slotted resistive body such as R3 which is trimmed in accordance with the present invention, it is desirable to have as many slots 20 and resistive links 22 as practical. Resolution of resistor network 10 is therefore largely limited by the number of resistive links 22. Simulations have found that the resolution of resistor networks 10 shown in FIG. 1 are well within acceptable limits. Significant improvements in resolution follow if fine-line lithography is used to define very narrow links and slots.

Uniform sensitivity, a situation in which changes in the overall resistance of resistor network 10 increase linearly as resistive body R3 is trimmed, is desired. Analysis of resistor network 10 reveals that resistance of resistive body R3 must increase linearly or uniformly to achieve a uniform trimmed sensitivity. A slotted resistive body which has resistive links of identical length, will, however, have uniform changes in conductance as it is trimmed. This provides a very nonuniform sensitivity in overall resistance.

To overcome this problem, resistive body R3 includes adjacent resistive links 22 which have lengths L which vary nonlinearly as a function of a parabola. The lengths L of resistive links 22 therefore increase as a function of a square of the length of adjacent links 22. When trimming a resistive body R5 such as that shown in FIG. 1 with links 22 having lengths of parabolic profile, the system shown in FIG. 3 will begin cutting with the shortest resistive link 22 (to the left of gap 30 in FIG. 1) and continue through to adjacent and longer resistive links 22. Gap 30 is a space between adjacent links 22 and is sized to permit insertion of a laser beam without affecting adjacent links 22. Links 22 to the right of gap 30 are not cut so there is always some resistance in parallel with resistor R4.

Although the present invention has been described with reference to preferred embodiments, workers skilled in the art will recognize that changes may be made in form and detail without departing from the spirit and scope of the invention.

What is claimed is:

1. An artificial anisotropic resistor medium fabricated on a substrate in accordance with design constraints of a fabrication technology, including:

a substrate;

at least two terminal elements;

a resistive body fabricated on the substrate and coupling the terminal elements; and a plurality of slots extending through the resistive body between the terminal elements to form a plurality of discrete resistive links coupled in parallel between the two terminal elements, wherein the slots have a width equal to a minimum width obtainable within the design constraints of the fabrication technology and the resistive links have a length profile which varies as a parabolic function.

2. The resistor of claim 1 wherein the slots have a maximum width of approximately three microns.

3. The resistor of claim 1 wherein the slots are parallel to one another.

4. The resistor of claim 1 wherein the slots extend across the entire resistive body between the terminal elements.

5. The resistor of claim 1 wherein the resistive links have a length profile which varies.

6. The resistor of claim 5 wherein the resistive links have a length profile which varies nonlinearly.

7. A distributed wye resistor network adapted for fabrication on a substrate utilizing a fabrication technology, including:

a substrate;

first and second terminals;

a first resistive body fabricated on the substrate and coupled to the first terminal;

a second resistive body fabricated on the substrate and coupled between the first resistive body and the second terminal; and an artificial anisotropic resistive body fabricated on the substrate and coupled between the first resistive body and the second terminal, wherein the artificial anisotropic resistive body includes a plurality of slots having a width equal to a minimum width obtainable within design constraints of the fabrication technology, extending through the resistive body to form a plurality of discrete resistive links coupled to each other in an electrically parallel arrangement.

8. The resistor network of claim 7 wherein the slots in the anisotropic resistive body have a maximum width of approximately three microns.

9. The resistor network of claim 7 wherein the slots in the anisotropic resistive body are parallel to one another.

10. The resistor network of claim 7 wherein the slots in the anisotropic resistive body extend across the entire anisotropic resistive body.

11. The resistor network of claim 7 wherein the resistive links of the anisotropic resistive body have a length profile which varies.

12. The resistor network of claim 11 wherein the resistive links of the anisotropic resistive body have a length profile which varies nonlinearly.

13. The resistor network of claim 12 wherein the resistive links of the anisotropic resistive body have a length profile which varies as a parabolic function.

14. The resistor network of claim 7 and further including a fourth resistive body fabricated on the substrate and coupled between the first resistive body and the third resistive body.

15. The resistor network of claim 14, and further including a fifth resistive body fabricated on the substrate and coupled in parallel with the third resistive body.

16. An integrated circuit resistor, including:

a substrate;

at least two terminal elements;

a resistive body fabricated on the substrate and coupling the terminal elements; and a plurality of slots having a maximum width of three microns extending through the resistive body between the terminal elements to form a plurality of discrete resistive links coupled in parallel between the two terminal elements.

17. The resistor of claim 16 wherein the slots are parallel to one another.

18. The resistor of claim 16 wherein the resistive links have a maximum width of six microns.

19. The resistor of claim 16 wherein the slots extend across the entire resistive body between the terminal elements.

20. The resistor of claim 16 wherein the resistive links have a parabolic length profile.

21. An integrated circuit resistor, including:

a substrate;

a pair of elongated terminal elements fabricated on the substrate;

a plurality of resistive links having a maximum width of six microns coupled between the terminal elements in an electrically parallel arrangement and spaced from one another by slots having a maximum width of three microns.

22. The resistor of claim 21 wherein a group of adjacent links from the plurality of links has a parabolic length profile.

* * * * *

UNITED STATES PATENT AND TRADEMARK OFFICE

CERTIFICATE OF CORRECTION

PATENT NO. : 4,774,492

DATED : September 27, 1988

INVENTOR(S) : John S. Shier

It is certified that error appears in the above-identified patent and that said Letters Patent is hereby corrected as shown below:

On the front page of the patent, please insert as Assignee:

— [73] Assignee: VTC Incorporated, Bloomington, Minn.—

Signed and Sealed this

Twenty-eighth Day of February, 1989

*Attest:*

DONALD J. QUIGG

*Attesting Officer*

*Commissioner of Patents and Trademarks*